United States Patent [19]

Akiyama et al.

[11] Patent Number: 4,709,845

[45] Date of Patent: Dec. 1, 1987

[54] APPARATUS FOR CONTINUOUSLY PRODUCING STEEL PIPES INCLUDING USING ROTABLE BEDS OF TOOLS FOR DIFFERENT SIZE PIPE

[75] Inventors: Masashi Akiyama, Kobe; Yasuo Tagashira, Miki, both of Japan

[73] Assignee: Kusakabe Electric & Machinery Co. Ltd., Japan

[21] Appl. No.: 4,836

[22] Filed: Jan. 13, 1987

Related U.S. Application Data

[63] Continuation of Ser. No. 620,841, Jun. 15, 1984, abandoned.

[30] Foreign Application Priority Data

Mar. 15, 1984 [JP] Japan ..... 59-50728

[51] Int. Cl.[4] ..... B23K 31/06

[52] U.S. Cl. ..... 228/17; 228/17.5; 29/39

[58] Field of Search ..... 228/17, 17.5, 152; 72/177, 477, 442, 52; 29/35.5, 39, 48.5 R, 43.42; 51/166 T; 114/5

[56] References Cited

U.S. PATENT DOCUMENTS

| | | | |
|---|---|---|---|
| 2,006,953 | 7/1935 | Klos | 51/166 T |
| 2,194,780 | 3/1940 | Anderson | 51/166 T |
| 3,248,954 | 5/1966 | Blake | 51/166 T |
| 3,619,897 | 11/1971 | Oppermann | 228/17 |
| 3,707,257 | 12/1972 | Wogerbauger | 228/17 |
| 4,339,938 | 7/1982 | Nakagawa et al. | 72/178 |

*Primary Examiner*—Nicholas P. Godici
*Assistant Examiner*—G. M. Reid
*Attorney, Agent, or Firm*—Saidman, Sterne, Kessler & Goldstein

[57] ABSTRACT

An apparatus for continuously producing electric-welded steel pipes by continuously supplying coiled strips as connected to one another by welding, progressively forming the strip into a tubular shape and high-frequency welding the opposed edges of the strip to form a seam. To produce required small quantities of steel pipes having varying diameters and wall thicknesses, a group of roll assemblies is replaceable by another group within a short period of time. Groups of forming, welding or sizing rolls are mountable on a polygonal bed which is lockable in position after rotation. For replacement, the bed is rotated by a hydraulic motor to bring the desired group of rolls to the proper position quickly.

10 Claims, 9 Drawing Figures

APPARATUS FOR CONTINUOUSLY PRODUCING STEEL PIPES INCLUDING USING ROTABLE BEDS OF TOOLS FOR DIFFERENT SIZE PIPE

This application is a continuation of application Ser. No. 620,841, filed June 15, 1984, now abandoned.

BACKGROUND OF THE INVENTION

1. Field of the Invention

The present invention relates to an apparatus for continuously producing electric-welded steel tubes or pipes by continuously supplying coiled strips as connected to one another by welding, progressively forming the strip into a tubular shape and high-frequency welding the butting edges of the strip to form a seam.

2. Description of the Prior Art

Apparatus are known for continuously producing steel pipes by progressively forming a steel strip into a tubular shape and welding together the opposed edges of the strip as disclosed in U.S. Pat. No. 4,339,938.

However, the conventional continuous production apparatus, which are suited for producing a large quantity of steel pipes of specified diameter, are inefficient to produce small quantities of steel pipes having varying diameters and wall thicknesses because all the forming rolls, welding rolls and sizing rolls must be replaced every time steel pipes of different diameter are to be produced. In fact, the replacement procedure entails the necessity of holding the apparatus out of operation frequently even for an entire day. The forming rolls, welding rolls and sizing rolls need to be replaced promptly while the apparatus is out of operation.

SUMMARY OF THE INVENTION

The main object of the present invention is to provide an apparatus for continuously producing a required quantity of steel pipes of desired diameter, the apparatus further being adapted to produce small quantities of steel pipes of different sizes with a reduced roll replacement time.

The apparatus of the invention comprises a polygonal bed which is rotatably mounted on a frame and which can be locked in a specified position after rotation. A series of forming, welding or sizing rolls are mounted on each of the sides of the polygonal bed which are revolvable about the axis of rotation of the bed. When a particular series of rolls are to be replaced by another series of rolls, the polygonal bed is rotated by a hydraulic motor to locate the desired group of rolls in the specified position. Thus, the present apparatus is adapted for the production of a wide variety of pipes in small quantities with a greatly reduced roll replacement time, consequently eliminating the common practice of manufacturing excess inventory by producing steel pipes in an amount more than is needed for a particular day.

DESCRIPTION OF THE PREFERRED EMBODIMENT

The present embodiment comprises a forming unit and a welding unit combined therewith, and a sizing unit which is separate from the combination because if otherwise, the overall combination would be too large and long. These three units may be united or separate from one another.

Electric-welded steel tubes or pipes having a welded seam are generally roll-formed by breakdown rolls, cluster rolls, finned rolls and squeeze rolls (for welding). The welded tubular product is cooled and thereafter treated by sizing rolls to obtain a pipe having an accurately circular or rectangular cross section.

In the initial stage of breakdown forming, a skelp or strip is bent progressively from portions thereof close to the edges, to increasing curvature.

Figure 1:
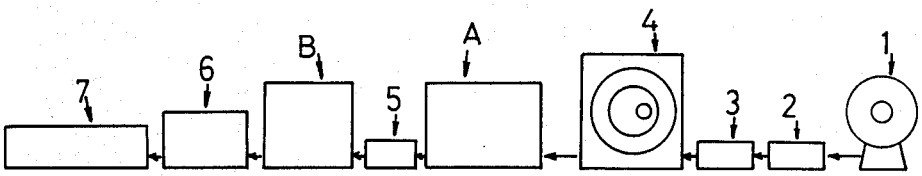
FIG. 1 is a diagram showing the overall layout of a continuous production apparatus embodying the present invention.

With reference to FIG. 1 showing the layout of an apparatus for continuously producing electric-welded pipes, indicated at 1 is a mother coil which has a limited length. At the tail end of the strip, the end is corrected to a planar form by an end shaping unit 2. The tail end of the strip and the leading end of another coiled strip are cut off and butt-welded by an end cutting-welding unit 3. Thus a continuous strip is fed to the apparatus.

Indicated at 4 is a strip accumulator for storing a portion of endless strip so as to afford a period of time for joining the ends of coiled strips. The strip is supplied from the accumulator 4 to a combined forming-welding unit A which comprises a forming unit including forming rolls and a welding unit. The strip is formed and welded in the forming-welding unit A, and the pipe obtained is cooled by a cooling unit 5 with a cooling oil and a cooling liquid comprising cooling water. The pipe is then fed to a sizing unit B comprising sizing rolls, whereby the pipe is shaped to an accurately circular rectangular cross section. The pipe is then accurately cut to the desired length by a travelling cutting unit 6. The lengths of pipe are transferred to a runout table 7 for storage.

The present invention relates to the construction of the forming-welding unit A and the sizing unit B which are the most essential components of such an apparatus for continuously producing steel pipes because the components of the continuous production apparatus other than these units A and B are amenable to use for pipes of varying diameters or wall thicknesses and can be used therefor by simple adjustment or almost in the same state without necessitating replacement.

On the other hand, tens of rolls included in the forming-welding unit A and the sizing unit B must be replaced in accordance with changes in the pipe diameter and wall thickness.

To assure replacement of such rolls by a single action, the apparatus of this invention comprises a rotatable polygonal bed the bed comprises a number of generally similar tool mounting surfaces for the mounting of several roll assemblies for forming tubing of different sizes. When required, the polygonal bed is merely rotated at the touch of a switch, whereby tens of rolls can be simultaneously replaced. Further if the rolls mounted on the bed are not suited to the production of pipes of specified diameter and wall thickness, suitable rolls are installed for replacement during the preceding pipe producing operation, such that the apparatus can be set for the production of specified pipes merely by rotating the bed at the touch of the switch.

The forming-welding unit A of FIG. 2 and the sizing unit B of FIG. 3 will be described.

Figure 2:
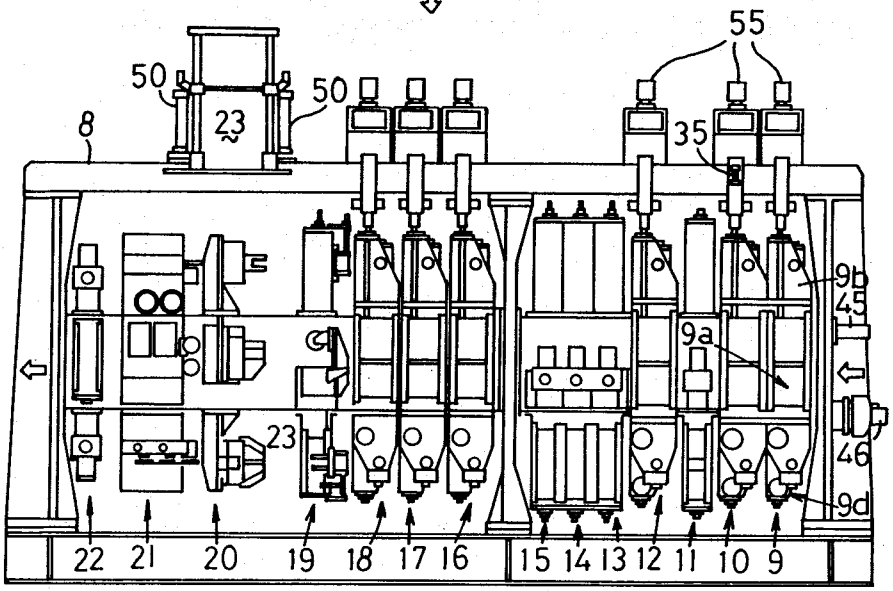
FIG. 2 is a front view showing a forming unit and a welding unit.
Figure 3:
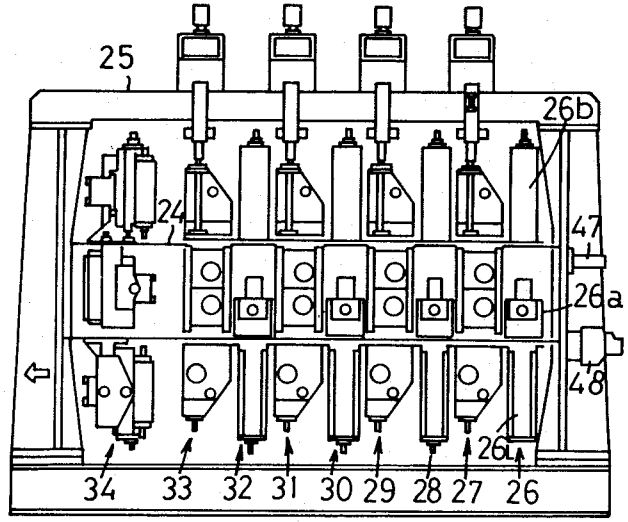
FIG. 3 is a front view showing a sizing unit.
Figure 4:
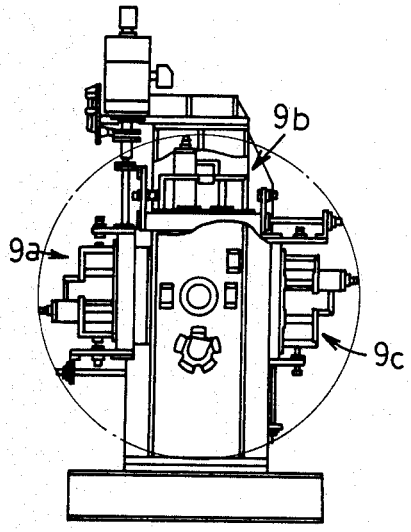
FIG. 4 is a side elevation showing the forming unit.
Figure 5:
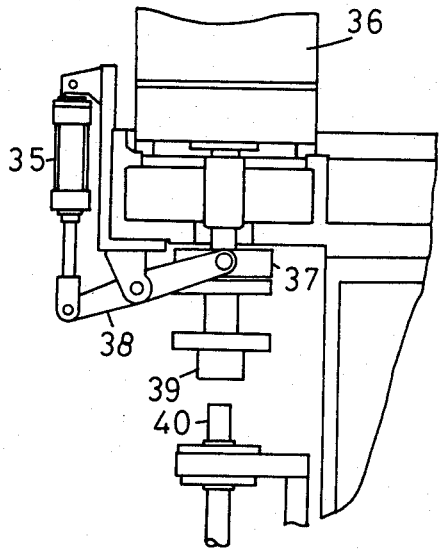
FIG. 5 is an enlarged side elevation showing a roll driving clutch unit.
Figure 6:
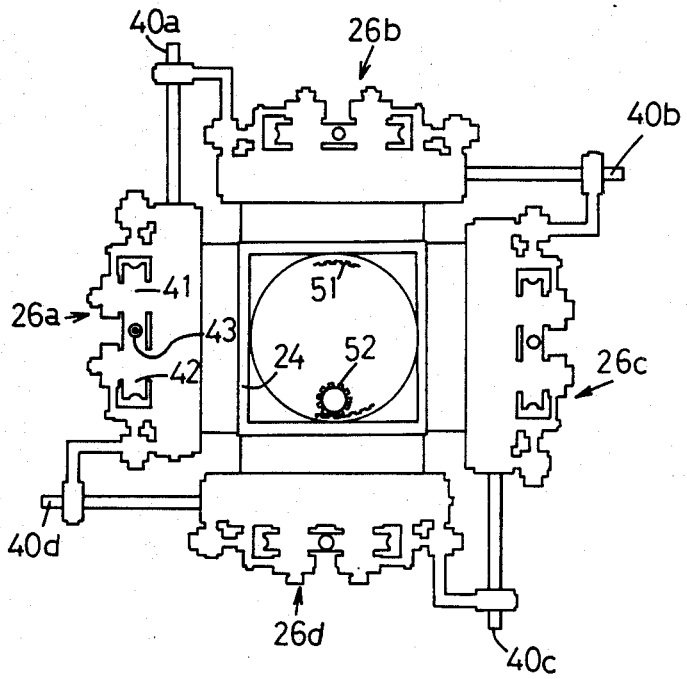
FIG. 6 is an enlarged side elevation in section schematically showing the sizing unit.

With reference to FIG. 2, a frame assembly 8 is in the form of a rectangular frame when seen from the front. A bed 23 having a square cross section is horizontally rotatably supported at its opposite ends by bearings on the frame. As shown in FIGS. 4 and 6, four groups of forming roll assemblies *9a, 9b, 9c* and *9d* are mounted on the bed 23 of square cross section so that each group will be positioned properly when brought to the front operator side by the rotation of the bed 23. Input shafts *40a, 40b, 40c* and *40d* are provided for the four groups, respectively. When a particular group is positioned on the front operator side, the clutch unit of FIG. 5 is fitted to the corresponding input shaft to deliver power to the group of roll assemblies.

FIG. 2 shows as arranged in the direction of feed of a strip a first breakdown roller assembly 9, second breakdown roll assembly 10, first side roll assembly 11, third breakdown roll assembly 12, first cluster roll assembly 13, second cluster roll assembly 14 and third cluster roll assembly 15 for rough forming.

The strip roughly formed to a tubular shape is then passed through three finned roll assemblies, i.e. a first finned roll assembly 16, second finned roll assembly 17 and third finned roll assembly 18, to accurately form a seam portion with opposite edges of proper curvature. Indicated at 19 is a seam guide roll assembly, whereby the slit pipe formed is fed to a squeeze roll assembly 20 in the next position with its slit seam accurately positioned. The squeeze roll assembly 20, adapted for electrically welding the pipe, includes a high-frequency welding device 49 which is held raised during preparation or adjustment. The device 49 is lowered by air cylinders 50 for the squeeze roll assembly 20 to weld the seam portion. After welding, the weld beads formed on the seam are removed by a bead cutter 21 to form an accurately curved surface. The formed and welded pipe is supported by a support roll assembly 22 and is fed to the cleaning unit 5 and then to the sizing unit B.

The cleaning unit 5 cools the pipe heated by forming and welding. Cooling oil and cooling liquid comprising cooling water are circulated for cooling. The pipe passing through the cleaning unit 5 is accurately sized to a circular or rectangular cross section.

FIG. 6 shows rolls 41 and 42 included in the sizing unit B. Such rolls have a successively reducing diameter to eventually obtain a pipe of desired diameter with a circular or rectangular cross section by sizing.

The sizing unit B comprises four groups of opposite side and upper and lower sizing roll assemblies. As seen in FIG. 3, each group comprises a first side sizing roll assembly 26, first upper and lower sizing roll assembly 27, second side sizing roll assembly 28, second upper and lower sizing roll assembly 29, third side sizing roll assembly 30, third upper and lower sizing roll assembly 31, fourth side sizing roll assembly 32 and fourth upper and lower sizing roll assembly 33 which are arranged in the direction of travel of the formed pipe.

After sizing, the torsion of the pipe is remedied by a correcting roll assembly 34.

The four groups of sizing roll assemblies are also mounted on a bed 24 having a square cross section and rotatably horizontally supported by a frame assembly 25.

The square bed 23 (24) is internally provided at its right end with an inner gear 51 having a large diameter. The inner gear 51 is in mesh with a drive gear 52 of a hydraulic motor 46 (48). When a switch is turned on by the operator, the drive gear 52 rotates to rotate the bed a quarter of a revolution.

When the bed rotating switch is turned on, a positioning pin is simultaneously removed by a hydraulic lock cylinder 45 (47), and upon completion of the rotation, the positioning pin is inserted into its hole again to hold the bed 23 (24) accurately in position.

Further when the switch is manipulated by the operator, the roll driving clutch unit shown in FIG. 5 is automatically engaged or disengaged. With reference to FIG. 5, a clutch cylinder 35 functions when the switch is actuated to cause an arm 38 and a shifter 37 to upwardly move a coupling 39 out of engagement with the input shaft 40 splined thereto. After the bed has been set in the desired position, the clutch unit operates in a reverse manner to the above to automatically engage the coupling 39 with the input shaft 40. Indicated at 36 is a roll driving motor.

With the present embodiment, the breakdown rolls, upper and lower sizing rolls, finned rolls, etc. are driven by the motor, while cluster rolls and side sizing rolls are not driven.

OPERATION

The apparatus of the present invention having the foregoing construction is operated in the following manner.

When there arises the need to produce pipes of altered diameter, suitable roll assemblies are mounted in advance on a side of each of the beds 23 and 24 other than the side carrying the roll assemblies currently in use. The strip is cut in the rear of the strip accumulator 4. Hydraulic or pneumatic operation is discontinued by switching. After confirming that the coupling and the positioning pin have been removed, the hydraulic motors 46 and 48 are driven at the same time to slowly rotate the beds 23 and 24. The hydraulic motors are provided with a speed reduction valve so as to rotate the beds at a very low speed when rotation of a quarter of a revolution is nearly completed and to enable the beds to stop at the proper position. If the desired roll assemblies are not positioned on the front operator side by this rotation, the beds are further rotated by a quarter of a revolution.

The forming-welding unit and the sizing unit are adapted to rotate at the same time.

The high-frequency welding device 49 is adapted to be raised before the rotation of the bed and to be lowered after the rotation with the movement of the coupling and the positioning pin.

Figure 7:
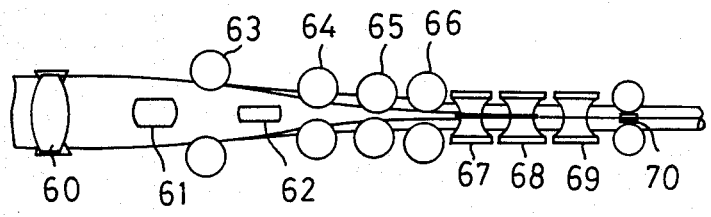
FIGS. 7 and 8 are a plan view and a side elevation schematically showing how a strip is formed into a pipe by rolls.
Figure 8:
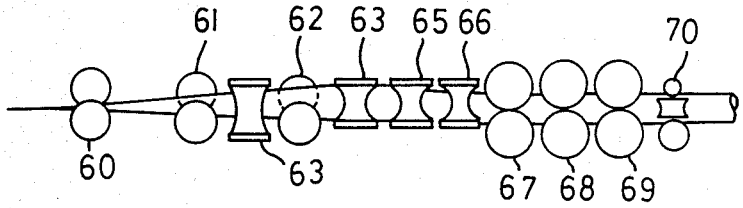
Figure 9:
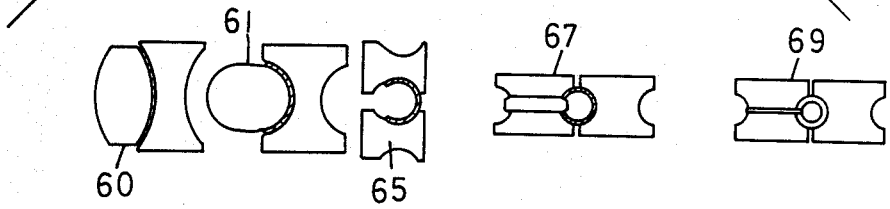
FIG. 9 shows the strip in cross section as it is formed by roll assemblies.

FIGS. 7 to 9 show how a strip is formed into a pipe by the above apparatus. The strip is roughly formed by breakdown rolls 60, 61, 62 and cluster rolls 63, 64, 65, 66, then has its seam portion accurately formed to the proper curvature by finned rolls 67, 68, 69 and is fed to a seam guide roll 70. Next, the seam portion is electrically welded by the squeeze rolls, and the weld beads are removed by the bead cutter. The pipe is thereafter sized accurately to a circular form by eight upper and lower and side roll assemblies including the sizing rolls 41 and 42 shown in FIG. 6.

When small quantities of a wide variety of pipes are to be produced in a plant for continuously manufacturing pipes to supply only a required quantiy at a desired time with a reduced stock of product, the present invention assures efficient use of a single production line because rolls, etc. are replaceable on the non-operative side of the bed even during operation, such that the desired group of roll assemblies can be set in position for actual operation at the touch of a switch. This serves to reduce the shutdown period of the plant and to eliminate the need for an excessive stock of pipes.

What is claimed is:

1. A tube-forming machine adapted for manufacture of tubing of varying sizes, comprising:

a base;

an elongated bed adapted to be pivoted about its axis of elongation with respect to said base, said bed being generally regularly polygonal in cross-section along its length so as to define a number of tool- mounting surfaces, each of said surfaces having removably mounted thereon a set of tools making up a tube-forming line for the forming of tubing;

means for controllably rotating said bed with respect to said base, between defined angular positions, such that in a given angular position the tools on one of said beds are properly aligned with means for supply of material to said tube-forming machine and with means for finishing tubes having been formed by said machine;

means for locking said bed with respect to said base except during relative rotation thereof; and drive means for driving at least some of said tools, wherein said drive means is stationary with respect to said base and comprises a motor and coupling means, said coupling means being actuated by a hydraulic cylinder for releasable engagement of said motor and said ones of said tools, wherein said means for locking is separate from said drive means.

2. The machine of claim 1, wherein said bed is generally square in cross section and defines four surfaces for the mounting thereto of sets of tools for the forming of tubing.

3. The machine of claim 1, wherein said means for controllably rotating said frame is a hydraulic motor.

4. The machine of claim 3, wherein said hydraulic motor rotates said bed by rotating a pinion engaged with an internal ring gear formed about the axis of said bed.

5. The machine of claim 1 wherein said means for locking said bed with respect to said base is a rigid locking pin and a hydraulic cylinder, said cylinder moving said pin between free and locking positions.

6. In a tube manufacturing system comprising means for supplying of a strip of material, a tube-forming machine and a tube-finishing machine, said tube-forming machine being of the type comprising a base and an elongated bed including a generally planar surface adapted for mounting thereto a sequence of tools for forming a tube from a strip of material, the improvement comprising:

said bed being of generally polygonal cross-section and mounted for rotation with respect to the base about an axis substantially at the center of said polygon, said bed comprising a number of similar generally planar surfaces having removably mounted thereon sequences of tools for forming tubes, said tube-forming machine comprising means for rotating said bed about said axis, said axis being located with respect to said means for supply of a strip of material and said tube-finishing machine such that rotation of said bed through a partial revolution successively brings ones of sequences of tools mounted on said surfaces into substantial alignment with said means for supply of a strip of material and said tube-finishing machine, said improvement further comprising locking means for positively locking said bed with respect to said base other than during said rotating, and stationary drive means mounted on said base for driving at least some of said tools of said sequences of tools, said drive means comprising a motor and a coupling means, driven by a hydraulic cylinder, for coupling said motor to said ones of the tools of the sequences of tools wherein said means for locking is separate from said drive means.

7. The tube manufacturing system of claim 6, wherein said bed is of generally square cross-section comprising four generally similar surfaces for having mounted thereto sequences of tools for forming tubes.

8. The system of claim 6, wherein said tube-forming machine comprises hydraulic motor means for rotating said bed.

9. The system of claim 8, wherein said hydraulic motor drives a pinion engaging a internal ring gear disposed about the axis of rotation of said bed.

10. The system of claim 6 wherein said locking means comprises a locking pin, movable between a first free position, in which said pin does not engage both of said bed and said base, and a second locking position, in which said pin engages mating apertures in said bed and said base, and a hydraulic actuator means for moving said pin between said free and locking positions.

* * * * *